US006102133A

United States Patent [19]

Scheid et al.

[11] Patent Number: 6,102,133

[45] Date of Patent: Aug. 15, 2000

[54] RAM

[75] Inventors: Winfried Scheid, Ebersbach; Stefan Mewes, Satuelle, both of Germany; Eberhard Ranft, Houston, Tex.

[73] Assignee: Delmag Maschinenfabrik Reinhold Dornfeld GmbH & Co., Germany

[21] Appl. No.: 09/000,322

[22] PCT Filed: Aug. 6, 1996

[86] PCT No.: PCT/EP96/03470

§ 371 Date: Mar. 10, 1998

§ 102(e) Date: Mar. 10, 1998

[87] PCT Pub. No.: WO97/07293

PCT Pub. Date: Feb. 27, 1997

[30] Foreign Application Priority Data

Aug. 11, 1995 [DE] Germany ..... 195 29 538

[51] Int. Cl.[7] ..... B25D 9/00

[52] U.S. Cl. ..... 173/208; 173/1; 173/135; 173/209

[58] Field of Search ..... 173/1, 2, 135, 173/137, 206, 208, 114, 209, 207; 175/19; 123/179.31, 46 H; 405/228, 232

[56] References Cited

U.S. PATENT DOCUMENTS

| | | | |
|---|---|---|---|
| 2,755,783 | 7/1956 | Kupka | 173/209 |
| 3,721,095 | 3/1973 | Chelminski | 173/2 |
| 4,007,803 | 2/1977 | Airhart | 173/135 |
| 4,096,916 | 6/1978 | Hennecke | 173/137 |
| 4,100,977 | 7/1978 | Elliott | 173/207 |
| 4,109,475 | 8/1978 | Schnell | 173/2 |
| 4,131,164 | 12/1978 | Hague | 173/1 |
| 4,580,641 | 4/1986 | Holland | 173/209 |

*Primary Examiner*—Peter Vo
*Assistant Examiner*—James Calve

[57] ABSTRACT

For selective operation in a Diesel mode and a pressure air mode a Diesel type pile hammer is additionally equipped with a pressure air accumulator, which is connected to the working space of the cylinder by a servo valve.

19 Claims, 1 Drawing Sheet

RAM

BACKGROUND OF THE INVENTION

1. Field of the Invention

The invention relates to a pile hammer with a hammering piston and a hammering member guided in a cylinder.

In such prior art pile hammers the unit for providing working gas includes means for feeding fuel and air to the working space. Thus these means produce an explosive mixture in the working space, which is ignited upon the hammering piston falling down.

2. Discussion of Relevant Art

In such known pile hammers the amplitude of the hammering piston can be adjusted by varying the amount of fuel injected into the working space. The impacts exerted by the hammering member onto an object to be hammered into the soil are thus generally harsh.

There are other prior art pile hammers, wherein a hammering piston is lifted by means-of a hydraulic actuator arranged outside of a guiding cylinder, the hammering piston thereafter being allowed to fall freely onto the hammering member. Such softly operating pile hammers are used particularly, where piles and the like must be hammered into soft soil or where production of heavy noise as produced by Diesel type pile hammers cannot be tolerated.

Diesel type pile hammers and hydraulic pile hammers differ considerably already as to their basic structure. If it is desired to obtain at one and the same operating site the advantages of hard or harsh hammering as well as the advantages of soft hammering, both types of pile hammers must be provided. This means considerable expenditures.

SUMMARY OF THE INVENTION

The object of the present invention is to improve a pile hammer such that its mode of operation can be switched between hard hammering and soft hammering.

In accordance with the invention this object is achieved by a pile hammer comprising a cylinder, a hammering piston guided in the cylinder and a hammering member guided in the lower end portion of the cylinder. A lower end face of the hammering piston forms an upper axial end wall, an upper face of the hammering member forms a lower axial end wall and the cylinder forms a circumferential wall of a variable working space. At least two different controllable working gas supply units and activating means to selectively activate one of said controllable working gas supply units to intermittently pressurize the working space are provided.

The pile hammer in accordance with the present invention can be supplied with pressurized working gas from at least two different working gas supply units, which working gas will lift the hammering piston arranged in the cylinder due to expansion of the working gas. Such a working gas supply unit is of simple structure as compared to the structure of a pile hammer, and consequently the invention allows for considerable savings as compared to simultaneous provision of two different types of hammers. Furthermore, it is possible to switch from one mode of operation to the other one during operation of the pile hammer and during pile-driving of one and the same pile. Thus one can take account in simple manner of the different properties of the soil encountered in different depths without the need of modifying or replacing the hammer.

If one of the working gas supply units is chosen to be a pressure air accumulator a particularly soft and careful way of pile-driving is obtained, when this working gas supply unit is activated. Provision of such a working gas supply unit on a Diesel type pile hammer requires only few and low cost additional structural features. A compressor for feeding the pressure air accumulator is normally available on construction sites anyway.

The pile hammer includes the following advantageous features: the pressure air accumulator is arranged immediately adjacent to the cylinder and connected thereto by means of a short connecting member having at least one control opening co-operating with a control member of a servo valve and being part of the valve means and activated by the activating means. This improvement of the invention is advantageous in that the pressure air accumulator can instantaneously discharge into the cylinder of the pile hammer under small throttling of the air. This is advantageous in view of rapid and effective acceleration of the hammering piston.

The pile hammer includes the following advantageous features: the control member is formed as a control plate and the connecting member comprises a plurality of parallel connection passageways. If the servo valve arranged between the pressure air accumulator and the cylinder is designed in accordance with this improvement, there is a high cross section for fluid flow, while the control member of the servo valve is exposed to small flexural loads, only.

The pile hammer includes the following advantageous features: the valve means comprise at least two servo valves, which are sequentially moved from their closing into their opening positions, and that one of the servo valves which is first moved into its open position is connected to a first region of the working space lying beneath a second region of the working space which is connected with that one of the servo valves which is moved into its open position at a later time. In a pile hammer in accordance with this improvement the hammering piston will first be accelerated from its rest position by opening a servo valve associated to a lower connection of the working space. The hammering piston will then later be exposed to the main portion of the pressure air contained in the pressure air accumulator by opening a further servo valve. This is advantageous in view of optimum lifting of the hammering piston.

The pile hammer includes the following advantageous features: a fluid driven actuator of that one of the at least two servo valves, which is moved into its open position at a later time is pressurized via a restriction. This improvement of the invention provides in a simple way for time delayed actuation of the servo valve associated to the upper feed connection of the cylinder.

The pile hammer includes the following advantageous feature: a check valve blocking fluid flow towards the actuator is connected across the restriction. In a pile hammer in accordance with this improvement the pressure fluid can flow out of the actuator associated to the servo valve without being restricted. Thus this servo valve can be rapidly closed after the desired acceleration of the hammering piston has been effected.

The pile hammer includes the following advantageous features: the servo valve actuator is a single acting fluid motor, which is biased into one end position by means of a spring, and a working line connected to this fluid motor in addition to the first restriction controlling the delay in the opening movement of the servo valve comprises a second restriction controlling discharge of working fluid, a check valve opening towards the fluid motor being connected across the second restriction. In a pile hammer in accordance with this improvement closure of said servo valve can be delayed in controlled manner without modifying its opening movement.

The pile hammer includes the following advantageous features: the actuator is connected to the outlet of a still further servo valve, through which a lowermost portion of the working space is connected to the pressure air accumulator. In accordance with this improvement the synchronization of the two servo valves, which control supply of pressure air to axially spaced position of the cylinder of the pile hammer, is obtained in a particularly simple way.

The pile hammer includes the following advantageous features: the still further servo valve comprises two counteracting fluid driven actuators, one of which being active in the opening direction is formed with a larger pressure exposed surface and receives the full pressure prevailing in the pressure air accumulator, while the other of these actuators, which acts in the closing direction receives only part of the pressure prevailing in the pressure accumulator and is assisted by a spring mechanically connected in parallel thereto. If the main control servo valve is designed in accordance with the above improvement and is connected to the other components as defined in this improvement, a fluidic multivibrator circuit controlling cyclic operation of the pile hammer in the pressure air operating mode is obtained in a simple way.

The pile hammer includes the following advantageous feature: the other of the two counteracting fluid driven actuators is pressurized via an adjustable pressure regulator. In connection with this improvement the amplitude of the hammering piston can be adjusted.

The pile hammer includes the following advantageous features: in its rest position the still further servo valve connects its working port to a pressure relief line and in that a connection line extending between its working port and the cylinder includes a check valve opening towards the cylinder. In a pile hammer in accordance with this improvement air can be discharged from the actuator of the servo valve associated to the upper pressure air feed position to the surrounding atmosphere, when the rest position of the servo valve is established, it being warranted, that no pressurized gas can flow back from the working space of the pile hammer to the servo valve. The pile hammer includes the following advantageous features: a feed port of the pressure air accumulator is connected to a feed side of a compressor via a check valve opening towards the pressure air accumulator.

The pile hammer includes the following advantageous features: one of the working gas supply units comprise a fuel trough formed in the upper end face of the hammering member and the lower pressure fuel injection unit to inject a volume of fuel into the fuel trough in response to movement of the hammering piston. In a pile hammer in accordance with the improvement an operating mode 'harsh Diesel hammering' can be selectively established, wherein the fuel is injected into a fuel trough, which is formed in the upper end face of the hammering member.

The pile hammer includes the following advantageous features: the working gas supply units comprise a high pressure fuel injection unit, which will discharge an amount of fuel into the lower portion of the working space, which amount of fuel is atomized under high pressure, injection of the fuel being effected in response to the movement of the hammering piston. In a pile hammer in accordance with the improvement an operating mode 'soft Diesel hammering' can be selectively established by actuating a high pressure fuel injection unit, which will discharge fuel into the working space, which is atomized under high pressure.

The pile hammer includes the following advantageous features: the working gas supply units each comprise at least one servo component by dint of which they can be selectively activated, and the control terminals of the different servo components are connected to the activating means, which in accordance with a selected position of a selecting switch will provide an activating signal for one of the servo components at a single of its output terminals at a given time, only. In a pile hammer in accordance with claim 16 there are positive means warranting that only one of the working gas supply units is activated at a given time.

BRIEF DESCRIPTION OF THE DRAWINGS

The invention will now be described in more detail by way of a preferred embodiment thereof and referring to the enclosed drawings. Therein the only

DETAILED DESCRIPTION OF PREFERRED EMBODIMENTS

Figure 1:
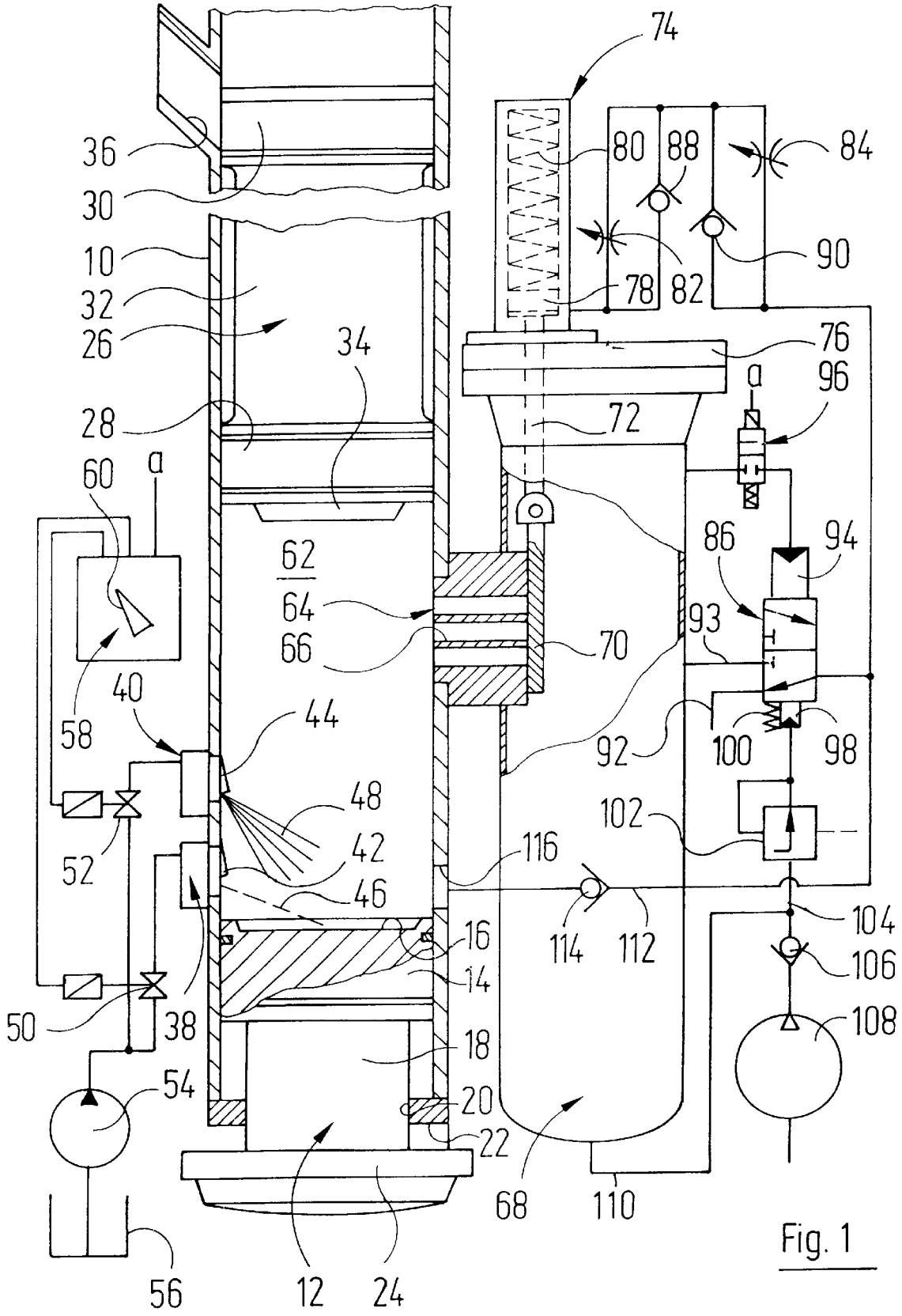
FIG. 1 is a schematic representation of a pile hammer, which can be operated in pressure air mode and in one of two different Diesel modes, respectively, some of the components being shown in section.

The pile hammer shown in the drawings has a cylinder 10, the lower end of which slidably receives a hammering member 12. The latter includes an upper piston portion 14, the upper end face of which is formed with a fuel trough 16. A intermediate cylinder portion 18 of the hammering member 12 is guided in an opening 20, which is formed in a lower end plate 22 of the cylinder 10. The intermediate portion 18 carries an exteriorly dish shaped massive hammering portion 24 having a convex curved lower end face.

The upper portion of the cylinder 10 guides a hammering piston 26 comprising a lower piston portion 28, an upper piston portion 30 as well a an intermediate piston portion 32 of somewhat reduced diameter. The lower end face of the piston portion 28 carries a projection 34 of small axial dimension, which is adapted to engage into the fuel trough 16.

The cylinder 10 is formed with a working slot 36, through which the pile hammer will take in air and discharge used working gas (detended pressure air and exhaust gases, respectively, when operating in a pressure air mode and in a Diesel mode, respectively). The wall of the cylinder further carries two fuel injection units 38, 40, which are only schematically shown and are fit into the wall of the cylinder. The fuel injection units comprise actuating levers 42, 44 co-operating with the circumferential surface of the hammering piston 26. Nozzles of the fuel injection units 38, 40 not shown in detail in the drawings provide a fuel jet 46 and a fuel spray 48, respectively.

The fuel jet 46 is provided by the fuel injection unit 38 under low pressure and is directed in such manner, that it will be collected in the fuel trough 16. Upon the hammering piston 26 falling down the fuel present in the fuel trough will then be atomized into the air which is heated by compression thereof.

The fuel spray 48 is discharged by the fuel injection unit 40 under high pression and is directly introduced into the compressed hot air. Thus in the high pressure injection mode combustion will be started at an earlier time (referring to the lower end position of the hammering piston) than in the low pressure injection mode. This results in the fact of the impact obtained upon the hammering piston 26 hitting the hammering member 12 will be somewhat softer. In the low pressure injection mode the mixture will be ignited only after harsh impact of the hammering piston 26 onto the hammering member 12.

The fuel injection units 38 and 40 are shown in the drawing as being located at axially spaced positions of the cylinder for better clarity. It is understood that in practical embodiments of the invention the two fuel injection units may also be displaced in circumferential direction (being at a same axial position of the cylinder) or may be staggered in axial as well as circumferential direction. It is further understood, that the fuel injection units each may comprise spaced pump units and nozzle units, respectively, and in such case one pump unit may feed a plurality of nozzle units spaced in circumferential and/or axial direction.

The fuel injection units 38, 40 are connected to the feed side of a fuel pump 54 via solenoid valves 50, 52. The fuel pump 54 draws Diesel fuel from a fuel tank 56.

The two fuel injection units 38, 40 can be selectively activated by energizing the associated one of the solenoid valves 50, 52. This may be effected by means of a control circuit 58 having a mode selecting switch 60.

At a third output terminal of the control circuit 58 will provide a further activating signal 'a', which is used for establishing the pressure air operating mode of the pile hammer as will now be described in more detail below.

At a lower portion of a working space 62 defined by the interior wall of the cylinder 10, the hammering member 12 and the hammering piston 26 a connecting member 64 is attached to the cylinder 10. The connecting member 64 comprises a plurality of connecting passageways 66 merging into the interior of a large pressure air accumulator 68. The end face of the connecting member 64 being situated in the pressure air accumulator 68 has control openings formed by the ends of the connecting passageways 66 which co-operate with the left hand main surface of a control plate 70 as seen in FIG. 1.

The control plate 70 is connected to a piston rod 72 of an actuator 74 attached to the upper side of an end plate 76 of the pressure air accumulator 68. A cylinder bore of the actuator 74 slidably receives a piston 78, which by means of a spring 80 is biased into a lower end position.

The working space defined by the lower end face of the piston 78 of the actuator 74 is connected to a working port of a servo valve 86 by means of two series connected adjustable restrictions 82, 84. A check valve 88 opening towards the actuator 74 is connected across the restriction 82, a further check valve 90 closing towards the actuator 74 being connected across the restriction 84. Thus the restriction 84 will throttle working fluid supplied to the actuator 74, while the restriction 82 will throttle working fluid discharged from the actuator 74 upon relief of pressure. By adjusting the restriction 84 the velocity of the control plate 70 in the opening direction can be varied, while adjusting of the restriction 82 will determine the velocity of the control plate 70 in the closing direction.

In the rest position of the servo valve 86 shown in the drawings the outlet of the servo valve 86 is connected to a relief line 92 being under atmospheric pressure. An inlet port of the servo valve 86 is connected to the interior of the pressure air accumulator 68 via a line 93.

An actuator 94 of the servo valve 86 is connectable to the interior of the pressure air accumulator 68 by way of a 2/2-solenoid valve 96. This connection to the pressure air accumulator is made at a position being remote from the site of connection of the line 93 so that the pressure fluid supply to the actuator 94 does not depend from dynamic effects which may occur at the merging site of the line 93. Control of the solenoid valve 106 is effected by the activating signal 'a' provided by the control circuit 58.

The servo motor 94 tends to establish the operating position of the servo valve 86. A further actuator 98 of the servo valve 86 is effective in the opposite sense as well as a biasing spring 100 mechanically connected in parallel to the actuator 98. The actuator 98 is connected to a feed line 104 by way of an adjustable pressure regulator 102. The feed line 104 is connected to the feed side of a compressor 108 by way of a check valve 106. The pressure air accumulator 68 is connected to the feed line 104 by a further line 110.

The working port of the servo valve 86 is further connected to a port 116 of the cylinder 10 communicating with the lowermost portion of the working space 26 by means of a working line 112 including a check valve 114 opening towards the cylinder 10.

In a pressure air operating mode (established by correspondingly positioning the selecting switch 60 and upon provision of the control signal 'a' at the output of the control circuit 58) the pile hammer described above will work as follows:

At the beginning of a cycle the hammering piston 26 rests on the hammering member 12. The compressor 108 continously feeds pressure air into the pressure air accumulator 68. At the beginning of the charging cycle of the pressure air accumulator 68 the total force provided by the low cross section actuator 98 and the biassing spring 100 exceeds the force provided by the actuator 94. Thus the servo valve 86 will first remain in its closed position shown in FIG. 1.

Once the pressure prevailing in the pressure air accumulator 68 has been sufficiently increased, the force provided by the actuator 94 will exceed the combined forces provided by the actuator 98 and the biassing spring 100 and the servo valve 86 will be switched into its operating position. In this position the pressure air feed port 116 of the cylinder 10 being at lower level is connected with the interior of the pressure air accumulator 68 via the now opening check valve 114 and the servo valve 86. The hammering piston 26 is now exposed to pressurized air and will be lifted by a first distance and will open those ends of the connecting passageways 66 which are adjacent to the cylinder 10.

The span of time which has lapsed up to this point corresponds to the time which is needed by the pressure prevailing at the outlet of servo valve 86 to lift the piston 78 overcoming the force provided by the spring 80, since the pressure air flows into the actuator 74 via the restriction 84 and the check valve 88. Now the ends of the connection passageways 66 which are adjacent to the accumulator 68 will be opened and the pressure air contained in the pressure air accumulator 68 will instantaneously discharge into the working space of the cylinder 10 thus throwing the hammering piston 26 in upward direction.

Obviously, the hammering piston 26 will be lifted by a distance depending on the pressure prevailing in the air pressure accumulator 68. This pressure is a function of the switching pressure of the servo valve 86, which in turn can be adjusted by the adjustable pressure regulator 102.

After the pressure in the pressure air accumulator 68 has been relieved this way, the servo valve 86 will be moved back into its rest position shown in the drawings by the now overbalancing combined forces of the actuator 98 and the biasing spring 100. In the rest position of the servo valve 86 the pressure air being under the piston 78 can now be vented to the atmosphere via the restriction 82 and the check valve 90 so that the control plate 70 will again close the connection passageways 66.

After the hammering piston 26 has fallen onto the hammering member 12 and has moved the latter and an object to be piled and contacting the hammering member 12 in downward direction, the operating cycle described above will start again.

After a predetermined number of pressure air cycles has been effected, the selecting switch 60 may then be moved into an intermediate operating position, wherein soft Diesel piling is carried out. To this end the control circuit 58 activates the solenoid valves 52. Thereafter each time that the hammering piston 26 approaches the hammering member 12 a fuel spray 48 will be injected into the working space of the cylinder. Ignition of the mixture thus produced will occur shortly before the hammering piston 26 will reach its lower end position. Ignition of the mixture will result in lifting of the hammering piston 26 and the exhaust gases will be discharged through the working slot 36. Upon further upward movement the hammering piston 26 will take in fresh air through the working slot 36, and upon the hammering piston falling down the air contained in the cylinder will be compressed once the hammering piston 26 has moved past the working slot 36 in downward direction. The hammering piston 26 will then actuate the fuel injection unit 38 and the cycle described above will start again.

If the selecting switch 60 is put in the position of harsh Diesel pile-driving fuel will be supplied to the fuel injection unit 40 instead to the fuel injection unit 38, since now the solenoid valve 50 is energized. The harsh pile-driving Diesel cycle will then be run in a similar way as described above in connection with high pressure fuel injection, with the only exception, that injection of the fuel is made into the fuel trough 16 and that ignition of the mixture will occur upon the hammering piston 26 impinging onto the hammering member 12.

As has been described above, the pile hammer in accordance with the invention can be operated selectively in one of three different operating modes for providing impacts of different intensity and of different time characteristics. Switching between the different operating modes can be effected during operation of the pile hammer.

It is to be noted that the pressure air operating mode of the pile hammering can also be used as a starting aid to launch Diesel operation of the hammer.

What is claimed is:

1. A pile hammer having at least two modes of continuous operation comprising a cylinder, a hammering piston guided in the cylinder and hammering member guided in the lower end portion of the cylinder, a lower end face of the hammering piston forming an upper axial end wall, an upper face of the hammering member forming a lower axial end wall and the cylinder forming a circumferential wall of a variable working space, at least two different controllable working gas supply units and activating means to selectively activate each one of said controllable working gas supply units to intermittently pressurize the working space for continuous hammering operation of said hammering member by each of said different working gas supply units, wherein said working gas supply units differ by at least one parameter selected from the group consisting of pressure of the working gas and response in time of the pressure of the working gas supplied by a working gas supply unit after having received an activating signal from said activating means.

2. The pile hammer in accordance with claim 1, wherein a first of the working gas supply unite comprises a pressure air accumulator, which is connected to a lower portion of the cylinder by valve means.

3. The pile hammer in accordance with claim 2, wherein the pressure air accumulator is arranged immediately adjacent to the cylinder and connected thereto by a short connecting member having at least one control opening co-operating with a control member of a servo valve and being part of said valve means and activated by said activating means.

4. The pile hammer in accordance with claim 3, wherein the control member is formed as a control plate and in that the connecting member comprises a plurality of parallel connection passageways.

5. The pile hammer in accordance with claim 2, wherein the valve means comprise at least two servo valves, which are sequentially moved from their closing into their opening positions and in that one of the servo valves, which is first moved into its open position is connected to a first region of the working space lying beneath a second region of the working space which is connected with that one of the servo valves which is moved into its open position at a later time.

6. The pile hammer in accordance with claim 5, wherein a fluid driven actuator of that one of said at least two servo valves which is moved into its open position at a later time is pressurized via a restriction.

7. The pile hammer in accordance with claim 6, wherein a check valve blocking fluid flow towards the actuator is connected across the restriction.

8. The pile hammer in accordance with claim 6, wherein the servo valve actuator is a single acting fluid motor, which is biased into one end position by a spring and in that a working line connected to this fluid motor in addition to the first restriction controlling the delay in the opening movement of the servo valve comprises a second restriction controlling discharge of working fluid, a check valve opening towards the fluid motor being connected across the second restriction.

9. The pile hammer in accordance with claim 6, wherein the actuator is connected to the outlet of a still further servo valve, through which a lowermost portion of the working space is connected to the pressure air accumulator.

10. The pile hammer in accordance with claim 9, wherein said still further servo valve comprises two counteracting fluid driven actuators, one of which being active in the opening direction is formed with a larger pressure exposed surface and receives the full pressure prevailing in the pressure air accumulator, while the other of these actuators, which acts in the closing direction receives only part of the pressure prevailing in the pressure accumulator and is assisted by a spring mechanically connected in parallel thereto.

11. The pile hammer in accordance with claim 10, wherein said other of the two counteracting fluid driven actuators is pressurized via an adjustable pressure regulator.

12. The pile hammer in accordance with claim 9, wherein said still further servo valve in a rest position thereof connects its working port to a pressure relief line and a connection line extending between its working port and the cylinder includes a check valve opening towards the cylinder.

13. The pile hammer in accordance with claim 2, wherein a feed port of the pressure air accumulator is connected to a feed side of a compressor via a check valve opening towards the pressure air accumulator.

14. The pile hammer in accordance with claim 1 wherein one of the working gas supply units comprises a fuel trough formed in the upper end face of the hammering member and a low pressure fuel injection unit to inject a volume of fuel into the fuel trough in response to movement of the hammering piston.

15. The pile hammer in accordance with claim 1, wherein the working gas supply units comprise a high pressure fuel injection unit, which will discharge an amount of fuel into the lower portion of the working space, which amount of fuel is atomized under high pressure, injection of the fuel being effected in response to the movement of the hammering piston.

16. The pile hammer in accordance with claim 1, wherein the working gas supply units each comprise at least one servo component by dint of which they can be selectively activated, and in that the control terminals of the different servo components are connected to said activating means, which in accordance with a selected position of a selecting switch will provide an activating signal for one of the servo components at a single of its output terminals at a given time, only.

17. The pile hammer in accordance with claim 1, wherein the working gas supply units comprise a high pressure fuel injection unit, which will discharge an amount of fuel into the lower portion of the working space, which amount of fuel is atomized under high pressure, injection of the fuel being effected in response to the movement of the hammering piston, the response of the high pressure fuel injection unit to movement of the hammering piston being adjustable.

18. A pile hammer comprising a cylinder, a hammering piston guided in the cylinder and a hammering member guided in the lower end of the cylinder, a lower end face of the hammering piston forming an upper axial end wall, an upper face of the hammering member forming a lower axial end wall and the cylinder forming a circumferential wall of a variable working space, at least two different controllable working gas supply units, and activating means to selectively activate one of said controllable working gas supply units to intermittently pressurize the working space, a first of the working gas supply units comprising a pressure air accumulator, that is connected to a lower portion of the cylinder by valve means, the pressure air accumulator being arranged immediately adjacent to the cylinder and connected thereto by a short connecting member having at least one control opening co-operating with a control member of a servo valve and being part of said valve means and activated by said activating means, the control member being formed as a control plate and the connecting member comprising a plurality of parallel connection passageways.

19. A pile hammer comprising a cylinder, a hammering piston guided in the cylinder and a hammering member guided in the lower end portion of the cylinder, a lower end face of the hammering piston forming an upper axial end wall, an upper face of the hammering member forming a lower axial end wall and the cylinder forming a circumferential wall of a variable working space, at least two different controllable working gas supply units, and activating means to selectively activate one of said controllable working gas supply units to intermittently pressurize the working space, a first of the working gas supply units comprising a pressure air accumulator that is connected to a lower portion of the cylinder by valve means comprising at least two servo valves that are sequentially moved from their closing into their opening positions, one of the servo valves that is first moved into its open position being connected to a first region of the working space lying beneath a second region of the working space that is connected with that one of the servo valves that is moved into its open position at a later time, a fluid driven activator of that one of said at least two servo valves that is moved into its open position at a later time being pressurized via a restriction.

* * * * *